US005403082A

United States Patent [19]

Kramer

[11] Patent Number: 5,403,082

[45] Date of Patent: Apr. 4, 1995

[54] FOLD-UP, MOVABLE DESK WITH MOVABLE AUDIOVISUAL EQUIPMENT END PORTION

[75] Inventor: Edward J. Kramer, Stanwood, Wash.

[73] Assignee: Synsor Corporation, Woodinville, Wash.

[21] Appl. No.: 174,755

[22] Filed: Dec. 29, 1993

Related U.S. Application Data

[63] Continuation of Ser. No. 901,404, Jun. 19, 1992, abandoned.

[51] Int. Cl.[6] ..... A47B 46/00; A47B 27/00

[52] U.S. Cl. ..... 312/249.9; 312/249.13; 312/223.3; 312/241; 312/223.6; 312/315; 108/115; 108/50; 108/69

[58] Field of Search ..... 312/249.13, 249.9, 223.3, 312/195, 241, 223.6, 313, 315; 108/112, 115, 95, 50, 69, 6

[56] References Cited

U.S. PATENT DOCUMENTS

| | | | |
|---|---|---|---|
| 313,768 | 3/1885 | Pringl | 312/241 |
| 1,179,017 | 4/1916 | McVicker | 312/313 |
| 1,299,331 | 4/1919 | Gydesen | 312/313 |
| 2,614,017 | 10/1952 | Mugnier | 312/249.9 |
| 2,739,859 | 3/1956 | Cohen | 108/115 |
| 2,829,935 | 4/1958 | Colleau | 312/195 |
| 2,878,092 | 3/1959 | Mitchell | 312/313 |
| 3,517,628 | 6/1970 | Swett | 108/152 |
| 4,026,616 | 5/1977 | Kuehl | 312/201 |
| 4,066,305 | 1/1978 | Gazarek | 312/223.6 |
| 4,307,672 | 12/1981 | Shikimi | 108/152 |
| 4,311,101 | 1/1982 | de Almagro | 108/152 |
| 4,491,375 | 1/1985 | Ugalde | 312/249.9 |
| 4,515,086 | 5/1985 | Kwiecinski | 108/95 |
| 4,960,307 | 10/1990 | Nelsen | 312/330.1 |

FOREIGN PATENT DOCUMENTS

| | | | |
|---|---|---|---|
| 268802 | 6/1988 | European Pat. Off. | 312/223.3 |
| 359642 | 10/1931 | United Kingdom | 312/241 |
| 8808681 | 11/1988 | WIPO | 108/112 |

*Primary Examiner*—Flemming Saether
*Attorney, Agent, or Firm*—Jensen & Puntigam

[57] ABSTRACT

The desk includes a support frame and a work surface (24) which is similar to conventional size desk surfaces. The work surface (24) is movable between a retracted, vertical position and an extended working position in which it is substantially horizontal. To the rear of the work surface (24) are a plurality of equipment platforms (32, 34, 36) for support of various equipment, such as a computer, a monitor, and a printer. At one end of the desk is a rotating platform assembly (68) which is adapted to support a slide projector or the like. At the other end of the desk is a foldable, semicircular conference assembly (86) which can be folded to lie adjacent the other end of the desk.

4 Claims, 3 Drawing Sheets

FOLD-UP, MOVABLE DESK WITH MOVABLE AUDIOVISUAL EQUIPMENT END PORTION

This is a continuation of application Ser. No. 901,404, filed Jun. 19, 1992, now abandoned.

TECHNICAL FIELD

This invention relates generally to a teacher's desk, typically for use in classrooms, and, more specifically, concerns such a desk which is readily movable from classroom to classroom and which has the capability of carrying several classroom equipment items.

BACKGROUND OF THE INVENTION

The conventional classroom teacher's desk is well-known. Typically, such desks have a fixed, flat,top surface, and several drawers for storage of various materials. Such a desk is designed to remain in a given position within the classroom, and can only be moved with significant effort. There is normally no provision in such a teacher's desk for carrying particular equipment useful in the classroom, such as audiovisual (AV) equipment, computer equipment, a VCR, etc. Typically, such equipment for use in the classroom is carried by equipment carts, which are usually readily movable because such carts have wheels. Usually the carts are sized so that they may move easily through doorways, from classroom to classroom. Such carts do have, however, the disadvantage of having little if any use other than for carrying equipment.

Hence, there is a need for a teacher's desk which is readily movable, but is also adapted to carry a variety of equipment, and which can be adapted to move through doorways. Also, there is a need for a desk having a capability of use for individual and group activities, supported by audiovisual and/or computer equipment.

SUMMARY OF THE INVENTION

Accordingly, in one embodiment, the invention is a movable desk, having an equipment carrying capability, comprising a support frame; wheels connected to the support frame so as to render the support frame movable; a work surface mounted on the support frame; and means located at one end of the support frame for support of a projection apparatus, said support means being movable relative to the support frame so that the projector can be used with different projection surfaces without moving the desk, and so that the desk can be moved relative to a particular projection surface.

In another embodiment, the invention comprises a support frame; wheels connected to the support frame so as to render the support frame movable; a work surface mounted on the support frame and movable between a first, retracted position and a second, extended position; and at least one platform member for supporting various equipment, located along a rear edge of the work surface when the work surface is in its second position, wherein the work surface and the equipment platform in combination are wider than a conventional doorway when the work surface is in its second, extended position, but when the work surface is in its first, retracted position, the desk is able to move through a doorway without otherwise dismantling the desk or removing equipment therefrom.

In still another embodiment, a desk includes a support frame; a work surface mounted on the support frame; and a pedestal assembly mounted on the support frame for movement between two positions, a first position being a retracted position within the support frame and the second position being an extended position relatively outwardly from the support frame.

BEST MODE FOR CARRYING OUT THE INVENTION

Figure 1:
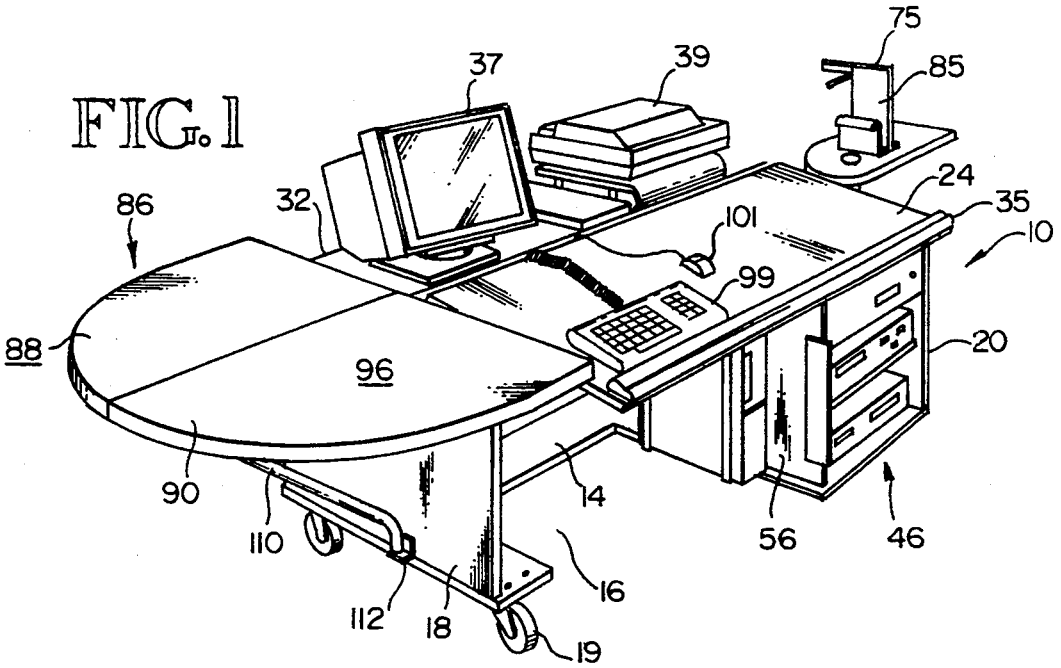
FIG. 1 is a perspective view of the desk of the present invention in an unfolded, working configuration.
Figure 2:
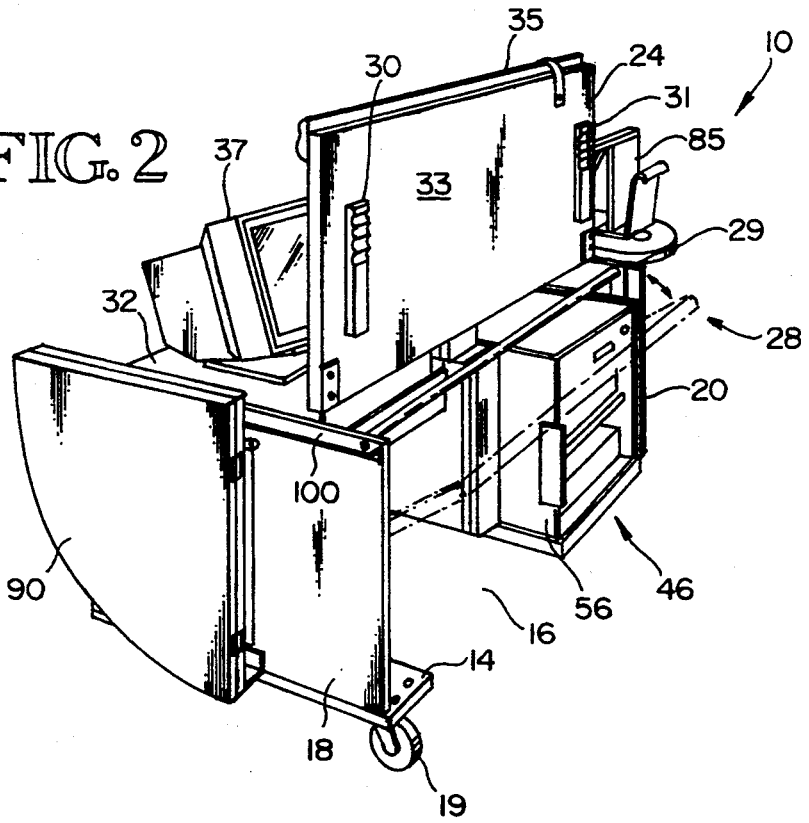
FIG. 2 is a perspective view of the desk of FIG. 1 in a folded configuration.

FIGS. 1 and 2 show perspective views of the desk of the present invention in both unfolded and folded configurations, respectively, while FIGS. 3–6 show in more detail several specific structural aspects of the desk. Referring to FIGS. 1–2 in particular, the desk shown generally at 10 includes a support frame which includes a base member or platform 14 having an opening 16 for accommodating the legs of the user of the desk. The base member in the embodiment shown is approximately 50 inches long by 30 inches deep. Extending upwardly at the opposing ends of the base member 14 are side members 18 and 20, which, in the embodiment shown, are approximately 30 inches across (wide) by 21 inches high. A rear member 22 is secured to base member 14 at the rear edge thereof and to the side members 18 and 20 at the rear edges thereof. In the embodiment shown, the support frame is typically made from wood, such as laminated particleboard, or the like, although it also could be made from metal. Attached to the support frame, generally at the corners of base member 14, are wheels 19—19. The wheels 19—19 permit the entire desk to be conveniently moved about and from room to room.

A work surface 24, in the shape of a rectangle, is supported at the top of the support frame. Work surface 24 in the embodiment shown is approximately 48 inches lung by 20 inches wide. Work surface 24 is pivotally mounted about pivot assemblies 21 and 23, which connect the work surface 24 to the two side members 18, 20. Generally, pivot assemblies 21, 23 take the form of rods about which the work surface 24 swivels. Typically, pivot assemblies 21, 23 are located near the top edge of the side members 18, 20 and about 12 inches rearward from the front edges thereof.

Figure 5:
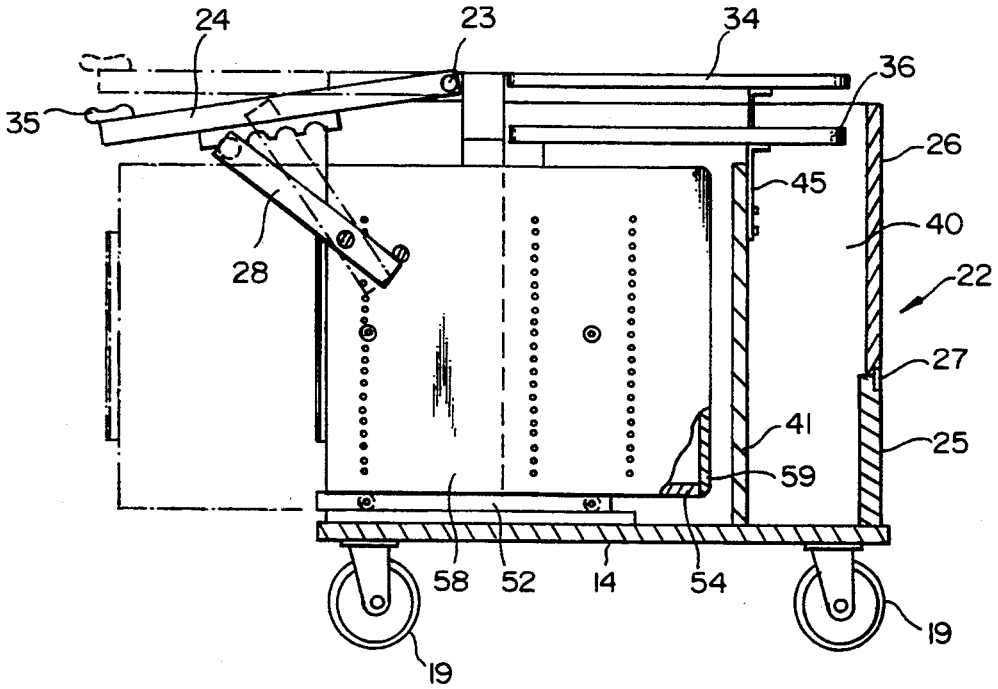
FIG. 5 is an end elevational view of the desk of FIG. 1.

This arrangement permits work surface 24 to be pivoted between a vertical, transport position, as shown in FIG. 2, and a working position which is substantially horizontal or slightly below the horizontal, as shown in FIG. 1. Work surface 24 is supported by a support arm 28, in the form of a shallow "U" which extends across the front of the desk and is mounted so that it can be locked into various angular positions, as shown in FIG. 5, for support of the work surface 24 over a range of angles, such as, for instance, from approximately horizontal to 8° below the horizontal. A longitudinal portion 29 of arm 28 is cylindrical and mates with receiving brackets 30, 31, mounted on the undersurface 33 of work surface 24. The receiving brackets 30, 31 included several concave portions, such that the angle of the work surface 24 depends upon which concave portion is used, as illustrated in FIG. 5. At the forward edge of work surface 24 is a retainer strip 35, against which various elements, such as pencils, papers, etc., can be rested, preventing movement thereof off the work surface.

In the working position, shown in FIG. 1, work surface 24 extends approximately 12 inches forward of the front edges of side members 18 and 20, providing a typical-sized desk workspace. Further, when work surface 24 is in its working position, the total depth of the desk is approximately 42 inches. When the work surface is in a vertical position, the total desk depth is reduced to approximately 30 inches (the width of side members 18 and 20), such that the desk can readily fit through conventional doorways.

Figure 4:
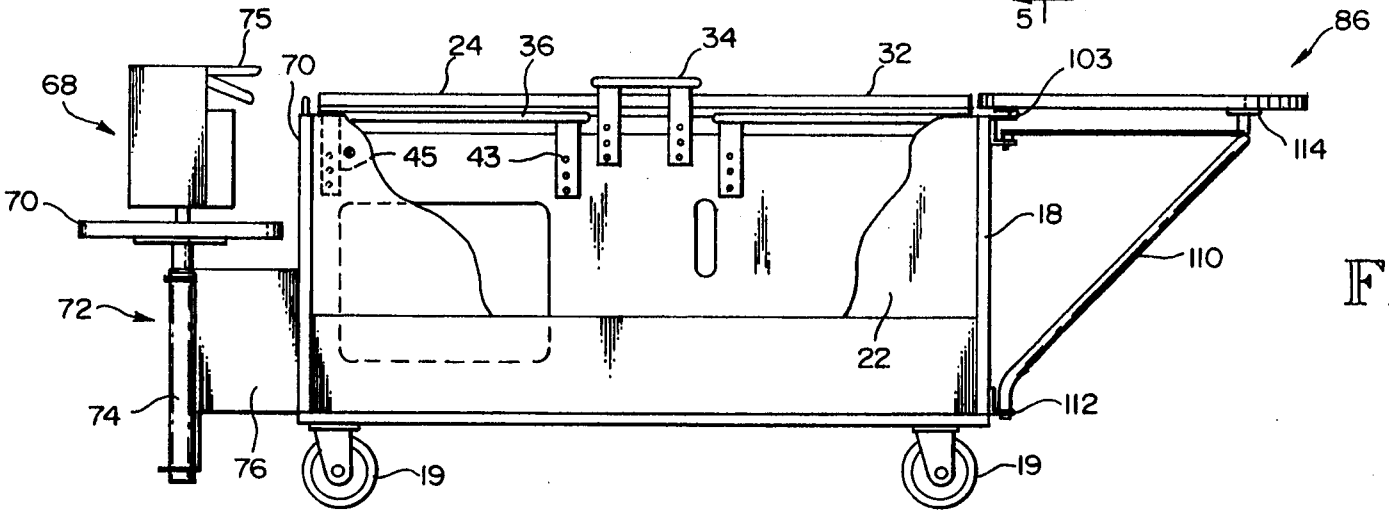
FIG. 4 is a rear elevational view of the desk of FIG. 1.
Figure 6:
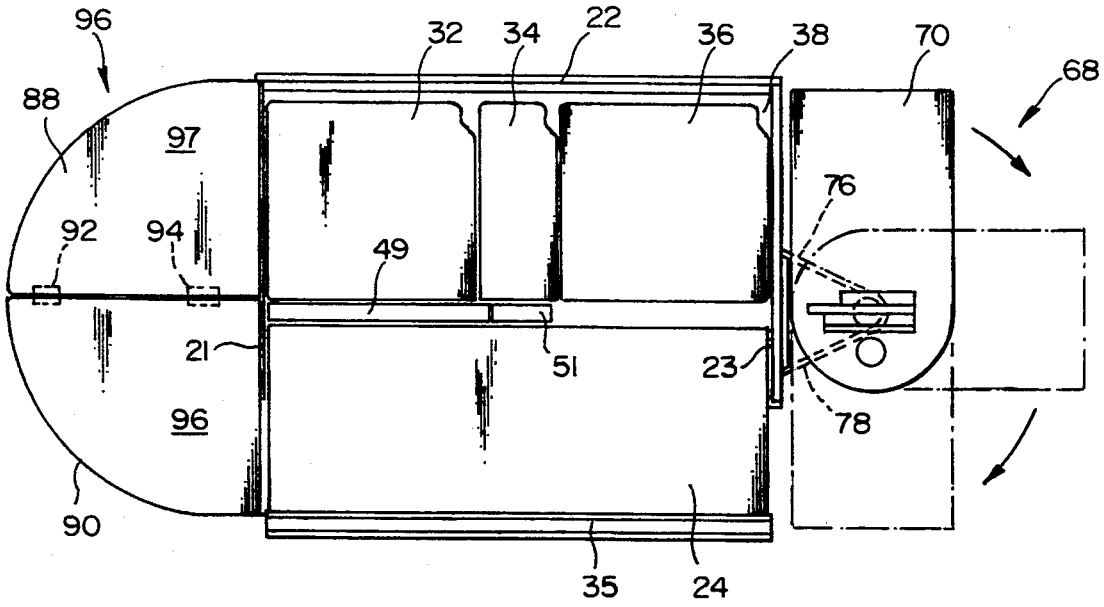
FIG. 6 is a top plan view of the desk of FIG. 1.

To the rear of work surface 24 in the embodiment shown are three equipment platforms 32, 34 and 36, shown most clearly in FIGS. 4–6. Each of the equipment platforms is supportable by brackets which may be moved between several different heights for convenience. Each of the platforms 32, 34 and 36 includes a notched portion, i.e. notch 38 in platform 36, to permit electrical cords from equipment supported by the platforms to extend below the platforms into a cord well discussed hereinafter. Platforms 32, 34 and 36 are sized and configured to accommodate particular equipment. For instance, platform 32 is designed to accommodate a computer monitor 37 (FIG. 1), while platform 36 is designed to accommodate a printer 39. The size and configuration of the equipment platforms may be varied.

Beneath platforms 32, 34 and 36 is a cord well 40, which is formed by a wall 41 (FIG. 5), which extends the length of the desk between side boards 18 and 20, approximately 6 inches forward of rear member 22. The equipment platforms 32, 34, 36 are supported by brackets from wall 41, for instance, brackets 43 and 45 support platform 36 shown in FIG. 4. The brackets can be easily moved vertically on wall 41, since several holes are predrilled in the brackets, providing a variable height capability for the platforms. Rear member 22 in the preferred embodiment comprises upper and lower portions 25, 26 hinged together by hinge 27 (such as a Soss hinge) so that portion 26 can be rotated outwardly and downwardly, providing convenient access to cord well 40.

Into cord well 40 are positioned electrical cords from the equipment carried by the desk. Typically within the cord well is a conventional electrical outlet strip (not shown) which includes a plurality of electrical outlet connections. A single electrical cord then extends from the electrical outlet strip through the rear member 22, side members 28, 20 or the base member 14 of the desk to a wall plug or to an extension cord. Hence, all of the electrical cords from the equipment carried by the desk of the present invention are accommodated conveniently and out of sight within cord well 40, with only a single electrical cord extending from the desk to the wall outlet. A single power switch thus can control power to all the equipment carried by the desk.

Located between work surface 24 and equipment platform 32 is a narrow receptacle 49 for storage of a computer keyboard, while a receptacle 51 for a "mouse" control unit is located between work surface 24 and equipment platform 34. Also a pencil tray, if desired, can be positioned between work surface 24 and equipment platform 36. It should be understood that the keyboard and mouse could be stored elsewhere on the desk and that receptacles 49 and 51 could be used for other elements.

Figure 3:
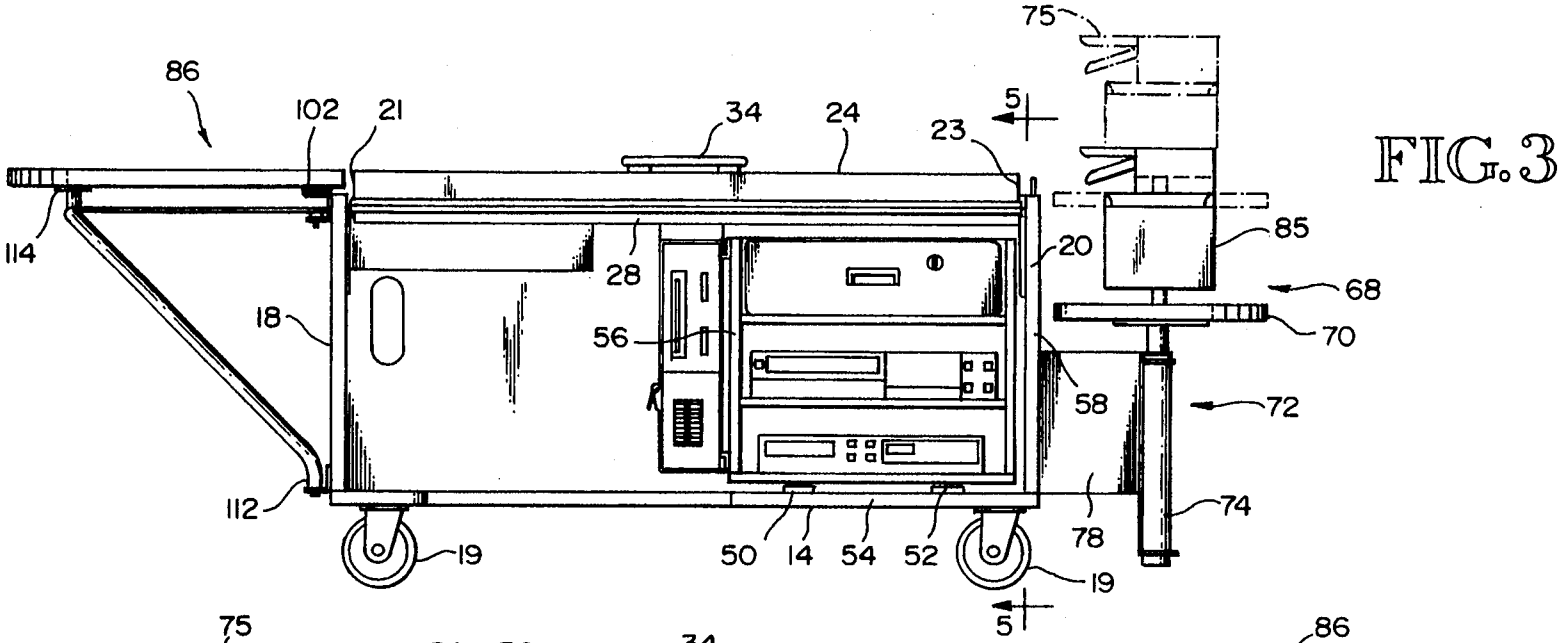
FIG. 3 is a front elevational view of the desk of FIG. 1.

Positioned within the support frame and supported by it is a pedestal unit 46, shown most clearly in FIGS. 1, 2, 3 and 5. Typically, pedestal unit 46 is located at the right hand side of the desk, although it could be located at other positions across the desk, or further, several pedestal units could be located across the desk. The pedestal unit 46 is supported on glides 50 and 52 mounted on base member 14 for in and out sliding movement of the pedestal unit. Pedestal unit 46 will typically comprise a bottom member 54, side members 56 and 58 and a rear member 59. Pedestal unit 46 can be made with sliding shelves, or to accommodate several drawers which slide in and out, or to carry additional equipment, or a combination thereof, as shown in FIG. 3. Additional equipment, such as a CPU for a computer, can be mounted adjacent member 56, as shown most clearly in FIG. 3. Pedestal unit 46 may be conveniently moved in and out relative to the support frame. The pedestal unit 46 is moved into an extended position when access to the pedestal unit is desired, whether the work surface 24 is in its vertical position or its working position. In its extended position, shown in FIG. 1, the front end of pedestal unit 46 is approximately 11 inches forward of the front edge of side member 20, which is approximately the front edge of the work surface 24 when the work surface is in its working position. When pedestal unit 46 is in its retracted position, it is entirely within the outline of the support frame, as shown in FIGS. 2 and 5. The pedestal unit is moved into its retracted position when work surface 24 is in its vertical, transport position, to permit convenient movement of the desk through doorways, as well as to provide knee space when work surface 24 is in its working position.

At the right hand side of the desk 10 is a movable equipment platform assembly, shown generally at 68, which is typically used to support audiovisual equipment, such as an overhead projector. Equipment platform assembly 68 includes a horizontal equipment support member 70, which in the embodiment shown is generally rectangular in configuration, with one end thereof being curved. The equipment support member 70 is mounted on a vertical positioning unit 72, which includes a gas cylinder 74 at the lower end thereof. The gas cylinder in operation moves support member 70 vertically, approximately 8 inches. The vertical positioning unit 72 typically extends above the equipment support member 70 approximately 11 inches, terminating in a hand-operated control unit 75 for the gas cylinder.

The vertical positioning assembly 72 is connected to side member 20 by an angled bracket 76. The equipment support member 70 is rotatable, so that it moves in an arc of approximately 180°, as illustrated in FIG. 6. A holder 85 for a liquid crystal display or the like is also part of the equipment platform assembly 68, as shown most clearly in FIGS. 1 and 2.

Positioned at the left-hand side of the desk 10 is a conference assembly, shown generally at 86. Conference assembly 86 is semicircular in configuration, comprising two approximately equal-size quarter sections 88 and 90. Section 90 is secured to section 88 by means of two Soss hinges 92 and 94, which are mounted in the adjoining edges of the respective quarter sections, thereby permitting section 90 to be rotated rearwardly, such that the upper surface 96 of section 90 lies flat against the upper surface 97 of section 88. A narrow support bracket 100 is secured to the side member 18 near the upper edge thereof, extending for most of the width of side member 18. This helps provide support and stability for the quarter sections when they are in an open position, as shown in FIG. 1. Hinges 102–103 connect quarter section 88 to bracket 100, so that section 88 is rotatable relative thereto.

Supporting conference assembly 86 is a support arm 110 which extends from a swivel point 112 at the bottom of side member 18, approximately 11 inches from the front edge thereof. The upper end of support arm 110 fits into a receptacle 114 located on the lower surface of quarter section 88, close to the edge thereof adjacent quarter section 90. When the conference assembly 86 is in its open, working configuration, as shown in FIGS. 1 and 6, for instance, the two quarter sections 88 and 90 are coplanar and in combination extend from the back edge of the desk to approximately the forward edge of the work surface 24 when the work surface is in its working configuration. The conference assembly 86 thus extends outwardly from side member 18 the same distance.

When the conference assembly 86 is to be moved into its retracted or folded configuration, section 90 is first rotated rearwardly about Soss hinges 92 and 94 so that the upper surface 96 of section 90 abuts the upper surface 97 of section 88. Section 88 (with section 90) is then raised slightly, about hinges 102, 103, permitting the upper end of support arm 110 to be removed from receptacle 114. Support arm 110 is then rotated so that it comes adjacent side member 18. The quarter sections 88 and 90 are then allowed to rotate downwardly about hinges 102, 103. When the conference assembly is in a folded configuration, the overall profile or footprint of the desk is substantially reduced.

In use, the desk combines several important features. First, the desk includes the capability of a full-size workspace, in addition to carrying a substantial amount of equipment. The desk is designed to accommodate a computer, with the monitor 37 on one of the equipment platforms and the keyboard 99 being positioned on the work surface 24. The keyboard 99 can be conveniently placed in a receptacle 49 immediately to the rear of the work surface when not in use. The accompanying mouse 101 may be positioned in receptacle 51. The desk, furthermore, is readily movable by means of wheels 19—19 supporting the desk. The work surface is foldable into a vertical position so that the entire desk can be readily moved between classrooms.

In addition, the desk has the feature of a platform at one end of the desk for mounting particular audiovisual equipment such as an overhead projector. The platform may be rotated so that an image may be projected against different projection surfaces without moving the desk, or the desk can be moved into various positions relative to a specific projection surface. The desk also includes a conference assembly at the other thereof, around which several students can be gathered for discussion and/or group work, possibly with some of the equipment, such as the computer. The conference assembly is readily foldable, permitting convenient movement of the desk. It should be understood that the audiovisual equipment platform and the conference assembly could be interchanged, end-for-end, or the audiovisual equipment platform and the conference assembly, respectively, could be used at both ends of the desk.

Although a preferred embodiment of the invention has been disclosed herein for illustration, it should be understood that various changes, modifications and substitutions may be incorporated in such embodiment without departing from the spirit of the invention which is defined by the claims that follow.

What is claimed is:

1. A movable desk having an equipment-carrying capability, comprising:

a support frame;

wheels connected to the support frame so as to render the support frame movable;

a work surface member having a front edge and a rear edge, mounted on the support frame so as to define a top surface of the desk, the work surface member being movable between first and second positions, wherein in the first position, the work surface member is in a working orientation and in the second position, the work surface member is rotated upwardly from its first position into a substantially vertical orientation such that the overall width of the desk is decreased sufficiently to permit movement of the desk through a conventional doorway;

a pedestal assembly located generally toward one end of and beneath the work surface member, leaving an opening beneath the work surface member to accommodate the legs of a seated user when the work surface member is in its first position, the pedestal assembly being supported entirely by the support frame for movement between first and second positions without the pedestal assembly contacting a floor surface on which the desk is positioned, wherein the first position of the pedestal assembly is a retracted position entirely within the support frame and the second position is an extended position relatively outwardly and forwardly from the support frame but still connected thereto, wherein, when the pedestal assembly is in its second position, a front surface thereof is in approximately the same vertical plane as the front edge of the work surface when said work surface is in its working orientation;

means located at one end of the support frame, supported by a portion of the desk other than the work surface, for support of a projection apparatus, said support means being rotatable horizontally and movable vertically relative to the remainder of the desk, such that said support means is movable relative to the remainder of the desk when the desk remainder is in a selected position and also such that the desk remainder can be moved relative to the support means and hence the projection apparatus when the projection apparatus is in a selected position; and a semicircular conference platform positioned at an opposing end of the support frame, wherein the semicircular conference platform includes two conference surface parts, one conference surface part mounted to be movable so as to lay adjacent the other conference surface part in one position and to be co-planar with the other part in another position, wherein the other part is movably connected to the support frame such that in one position, the other part, with the one part, lies adjacent the opposing end of the support frame, while in another position, the other part is substantially horizontal.

2. An apparatus of claim 1, including means for supporting the work surface member at a plurality of different angles when the work surface member is in its first position.

3. An apparatus of claim 1, including means at the rear of the desk defining a receptacle for power cords for equipment carried by the desk and a power outlet strip.

4. An apparatus of claim 1, including a plurality of platform members, each separate from the work surface member, extending for substantially the entire length of the desk along a rear edge of the work surface member, for support of various equipment.

* * * * *